US010512919B2

(12) United States Patent
Eliasson

(10) Patent No.: US 10,512,919 B2
(45) Date of Patent: Dec. 24, 2019

(54) CENTRIFUGAL SEPARATOR HAVING A DRAINAGE OUTLET DOWNSTREAM OF AN UPSTREAM PORTION OF THE GAS OUTLET

(71) Applicant: ALFA LAVAL CORPORATE AB, Lund (SE)

(72) Inventor: Thomas Eliasson, Älvsjö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 570 days.

(21) Appl. No.: 15/305,290

(22) PCT Filed: Apr. 30, 2015

(86) PCT No.: PCT/EP2015/059457
§ 371 (c)(1),
(2) Date: Oct. 19, 2016

(87) PCT Pub. No.: WO2015/166024
PCT Pub. Date: Nov. 5, 2015

(65) Prior Publication Data

US 2017/0036221 A1 Feb. 9, 2017

(30) Foreign Application Priority Data

Apr. 30, 2014 (EP) ..... 14166551

(51) Int. Cl.
*B04B 5/08* (2006.01)
*B04B 7/04* (2006.01)
(Continued)

(52) U.S. Cl.
CPC ..... *B04B 5/08* (2013.01); *B04B 7/04* (2013.01); *B04B 11/02* (2013.01); *F01M 13/04* (2013.01); *F01M 2013/0422* (2013.01)

(58) Field of Classification Search
CPC ..... B04B 5/005; B04B 5/08; B04B 11/02; B04B 5/12; B04B 7/14; B04B 7/04; B04B 2005/125; F01M 13/04; F01M 2013/0422
(Continued)

(56) References Cited

U.S. PATENT DOCUMENTS 3,234,716 A 2/1966 Sevin et al.
4,087,924 A 5/1978 Fujimoro et al.
(Continued)

FOREIGN PATENT DOCUMENTS

CN 1961139 A 5/2007
CN 101203319 A 6/2008
(Continued)

OTHER PUBLICATIONS

International Search Report and Written Opinion issued in corresponding PCT Application No. PCT/EP2015/059457, dated Jul. 17, 2015, pp. 1-8.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator for cleaning a gas containing liquid impurities includes a stationary casing, enclosing a separation space and a surrounding side wall, a first end wall and a second end wall. An inlet extends through the stationary casing and permits supply of the gas to be cleaned. A rotating member includes a stack of separation disks rotatable around an axis of rotation by means of a drive member. A gas outlet permits discharge of cleaned gas and comprises an outlet opening through the stationary casing and an upstream portion extending from the outlet opening. A drainage outlet permits discharge of liquid impurities separated from the
(Continued)

gas. The drainage outlet is provided in the gas outlet downstream the upstream portion. The gas outlet conveys the liquid impurities to the drainage outlet.

20 Claims, 8 Drawing Sheets

(51) Int. Cl.
*B04B 11/02* (2006.01)
*F01M 13/04* (2006.01)

(58) Field of Classification Search
USPC ..... 494/67, 68, 70, 72, 74; 123/41.86; 55/385.3, 451; 95/269, 270; 96/216
See application file for complete search history.

(56) References Cited

U.S. PATENT DOCUMENTS

| | | | |
|---|---|---|---|
| 7,992,551 | B2 | 8/2011 | Shieh |
| 2006/0142135 | A1 | 6/2006 | Hallgren et al. |
| 2009/0000258 | A1 | 1/2009 | Carlsson et al. |
| 2009/0025562 | A1 | 1/2009 | Hallgren et al. |
| 2009/0025563 | A1 | 1/2009 | Borgstrom et al. |
| 2010/0011723 | A1 | 1/2010 | Szepessy et al. |
| 2011/0011380 | A1 | 1/2011 | Lagerlöf et al. |
| 2011/0281712 | A1 | 11/2011 | Schlamann et al. |
| 2014/0051563 | A1 | 2/2014 | Mackel et al. |

FOREIGN PATENT DOCUMENTS

| | | | |
|---|---|---|---|
| CN | 101384329 | A | 3/2009 |
| CN | 101970814 | A | 2/2011 |
| CN | 102470378 | A | 5/2012 |
| CN | 102821866 | A | 12/2012 |
| CN | 103097674 | A | 5/2013 |
| CN | 103153474 | A | 6/2013 |
| DE | 102008033638 | A1 | 2/2009 |
| EP | 2584160 | A1 | 4/2013 |
| JP | 52-135453 | A | 11/1977 |
| JP | 56-24960 | U | 7/1979 |
| JP | 59-171338 | A | 11/1984 |
| JP | 3-86051 | U | 8/1991 |
| JP | 9-512311 | A | 12/1997 |
| JP | 2008-543535 | A | 12/2008 |
| JP | 2009-526631 | A | 7/2009 |
| JP | 2009-526645 | A | 7/2009 |
| JP | 2010-142807 | A | 7/2010 |
| JP | 2011-515612 | A | 5/2011 |
| JP | 2011-528280 | A | 11/2011 |
| WO | WO 95/29291 | A1 | 11/1995 |
| WO | 2005087384 | A1 | 9/2005 |
| WO | WO 2005/119020 | A1 | 12/2005 |
| WO | WO 2006/132577 | A1 | 12/2006 |
| WO | 2007094725 | A1 | 8/2007 |
| WO | 2009108046 | A1 | 9/2009 |
| WO | WO 2009/116897 | A1 | 9/2009 |
| WO | 2011005160 | A1 | 1/2011 |
| WO | WO 2011/126436 | A1 | 10/2011 |
| WO | 2012036796 | A1 | 3/2012 |
| WO | WO 2012/035089 | A1 | 3/2012 |
| WO | 2012152925 | A2 | 11/2012 |
| WO | 2013067245 | A1 | 5/2013 |

OTHER PUBLICATIONS

English translation of the Japanese Notice of Reasons for Rejection, dated Nov. 20, 2017, for Japanese Application No. 2016-565259.
International Search Report and Written Opinion of the International Searching Authority (Forms PCT/ISA/237 and PCT/ISA/210), dated Jul. 17, 2015, for International Application No. PCT/EP2015/059451.
English translation of a Chinese Search Report for Chinese Application No. 201580023608.9, dated Feb. 2, 2018.
English translation of a Japanese Notice of Reasons for Rejection for Japanese Application No. 2016-565233, dated Jan. 29, 2018.
English translation of the Japanese Decision of Rejection for Japanese Application No. 2016-565259, dated Mar. 4, 2019.
English translation of the Japanese Decision to Reject the Amendments for Japanese Application No. 2016-565259, dated Mar. 4, 2019.

CENTRIFUGAL SEPARATOR HAVING A DRAINAGE OUTLET DOWNSTREAM OF AN UPSTREAM PORTION OF THE GAS OUTLET

CROSS REFERENCE TO RELATED APPLICATION

This application is a National Stage Application of and claims priority to PCT Application No. PCT/EP2015/059457, filed on Apr. 30, 2015, which is a PCT Application of and claims priority to EP Application No. 14166551.3, filed on Apr. 30, 2014, the subject matter of which applications is incorporated by reference herein in their entirety. This application is also related to application which is concurrently being filed on even date of the present application, which claims priority to PCT Application No. PCT/EP2015/059451, filed on Apr. 30, 2015, which is a PCT Application of and claims priority to EP Application No. 14166549.7, filed on Apr. 30, 2014.

TECHNICAL FIELD

The present invention refers to a centrifugal separator for cleaning a gas containing liquid impurities. In particular, the centrifugal separator according to the invention is configured for cleaning oil particles from crankcase gases of a combustion engine, the centrifugal separator having a drainage outlet in an upstream portion of the gas outlet.

BACKGROUND

WO 2007/094725 discloses a centrifugal separator having a gas inlet that extends through the bottom of the centrifugal separator. The outlet opening of the gas outlet is provided through the side wall above the stack of separating disks adjacent to an upper one of the end walls. Separated liquid impurities are discharged through the side wall.

WO 2005/087384 discloses a centrifugal separator having a gas inlet that extends through the top of the centrifugal separator. The outlet opening of the gas outlet is provided through the side wall below the stack of separating disks adjacent to a lower one of the end walls. Separated liquid impurities are discharged through the side wall.

US 2011/0281712 discloses a centrifugal separator for cleaning crankcase gases having an outlet opening of the gas outlet that extends through an upper end wall of the centrifugal separator. An inlet opening of the gas inlet extends through the lower end wall. Separated liquid impurities are discharged through the lower end wall.

One problem of the prior art centrifugal separators is that they have a relatively large size requiring a large space. This is a significant problem, especially when the centrifugal separator is used for cleaning crankcase gases from smaller combustion engines, preferably from smaller diesel engines, to be used especially in lighter trucks and the like.

One way of reducing the size of the centrifugal separator is to reduce the diameter of the stack of separation disks. However, in order to maintain the separation efficiency, the height or the length of the stack then has to be increased.

SUMMARY

The object of the present invention is to remedy to the problem discussed above, and more precisely to provide a centrifugal separator having a reduced or compact size while maintaining or improving the separation efficiency.

This object is achieved by the centrifugal separator initially defined, which has a drainage outlet provided in the gas outlet downstream the upstream portion, wherein the gas outlet is configured to convey the liquid impurities to the drainage outlet.

By conveying the liquid impurities separated from the cleaned gas in the gas outlet, a more compact solution is achieved. Only one single outlet channel from the stationary casing is required for both the liquid impurities and the cleaned gas. The gas outlet is configured to convey the cleaned gas along a central flow in the gas outlet and the liquid impurities along the inside walls of the gas outlet to the drainage outlet.

According to an embodiment of the invention, the gas outlet comprises an outlet conduit having an entry portion provided downstream the upstream portion, wherein the drainage outlet comprises a ditch extending around the entry portion of the outlet conduit. The central flow of the cleaned gas may thus be conveyed through the entry portion of the outlet conduit. The liquid impurities will be collected in the ditch provided around the entry portion.

According to a further embodiment of the invention, the drainage outlet comprises at least one drainage opening extending from the ditch. The liquid impurities collected in the ditch will be drained from the ditch through the drainage opening for further transport to any suitable position. The liquid impurities will be drained together with a small amount of cleaned gas, at least in relation to the amount of cleaned gas in the central flow. Advantageously, more than one drainage opening extends from the ditch, for instance two, three, four or even more drainage openings.

According to a further embodiment of the invention, the gas outlet has a downstream portion provided downstream the upstream portion and having an increasing cross-section. Such an increasing cross-section is fluid dynamically advantageous by permitting recover of the pressure drop at the outlet opening. Advantageously, the upstream portion may have a constant cross-section.

According to a further embodiment of the invention, the drainage outlet and the entry portion of the outlet conduit are provided at the downstream end of the downstream portion.

According to a further embodiment of the invention, the downstream portion extends form the upstream portion. The downstream portion may thus start directly where the upstream portion ends.

According to a further embodiment of the invention, the outlet opening of the gas outlet extends through the side wall of the stationary casing. Since the gas outlet extends from the outlet opening through the side wall, both the cleaned gas and the liquid impurities may be given a velocity in a tangential direction and may thus be easily discharged through the outlet opening in the side wall, and kept separated in the gas outlet.

According to a further embodiment of the invention, an end space is provided outside the separation space and communicates with the drainage outlet via a drainage channel that extends from the at least one drainage opening. The drainage opening or drainage openings have a total flow area that is restricted to create a lower pressure in the end space than in the radially outer part of the separation space. The liquid impurities will thus be conveyed to the end space, especially together with the small amount of cleaned gas, thanks to this pressure difference. From the end space, the liquid impurities, such as oil, may be transported through one or two bearings supporting the rotating member, and/or back to the oil system of the combustion engine.

According to a further embodiment of the invention, a central suction opening extends between the separation space and the end space through the second end wall to permit a re-circulating gas flow from the end space to the separation space. The pressure in the central part of the separation space will be lower than in the radially outer part due to the pumping effect of the stack of separation disks. The pressure in the central part of the separation space will also be lower than the pressure in the end space.

According to a further embodiment of the invention, a fan member is provided between the second end wall and the stack of separation disks to further promote said re-circulating gas flow. Advantageously, the fan member is attached to the spindle and rotates together with the stack of separation disks.

According to a further embodiment of the invention, the second end wall adjacent to the side wall has a number of apertures providing communication channels between the separation space and the end space for separated liquid impurities. Liquid impurities collected on the second end wall may thus be drained to the end space.

According to a further embodiment of the invention, the upstream portion has upstream outlet walls that are substantially parallel with each other. The downstream portion may have downstream outlet walls that are diverging. Gas outlet is thus delimited by the inside walls which comprise the upstream outlet walls and the downstream outlet walls.

According to a further embodiment of the invention, the stationary casing has a radius R from the axis of rotation to the surrounding side wall, wherein the upstream portion extends from the outlet opening in an outlet direction, wherein the outlet direction extends through an upstream point of the outlet opening and is parallel with a transversal line extending through the axis of rotation, the perpendicular distance between the outlet direction and said transversal line is at least 0.8R and at the most 1.2R, especially with respect to the radius R opposite to the outlet opening. Such an extension of the outlet direction decreases the flow resistance for the gas flow exiting the separation space. Advantageously, the perpendicular distance between the outlet direction and said line may be at least 0.9R and at the most 1.1R. Moreover, the perpendicular distance between the outlet direction and said transversal line may be equal to, or substantially equal to, the radius R Such an extension of the outlet direction results in a minimum flow resistance for the gas flow leaving the separation space.

According to a further embodiment of the invention, the outlet opening has an elongated shape along a longitudinal direction and is positioned opposite to the stack of separation disks. Such an opening with an elongated shape, or in the form of a slot, through the side wall of the casing, is advantageous since it permits a uniform distribution of the flow of gas over a large area.

According to a further embodiment of the invention, the stack of separation disks has an outer circumferential periphery and an axial length at the outer circumferential periphery, wherein the outlet opening along the longitudinal direction has a length which is 80-130% of the axial length. This feature contributes further to a uniform gas flow through the whole stack of separation disks, i.e. to an equal gas flow in each of the gaps between adjacent separation disks. Advantageously, the length may be 90-120% of the axial length, especially 100-110% of the axial length.

According to a further embodiment of the invention, the separation disks are provided at a distance from each other to form a gap between adjacent separation disks. Advantageously, each gap may be positioned opposite, or just opposite, the outlet opening. Furthermore, the rotating member may define a central space formed by at least one hole in each of the separation disks and connected to the inlet and configured to convey the gas to be cleaned from the inlet to the gaps of the stack of separation disks.

BRIEF DESCRIPTION OF THE DRAWINGS

The invention is now to be explained more closely through a description of various embodiments and with reference to the drawings attached hereto.

DETAILED DESCRIPTION

Figure 1:
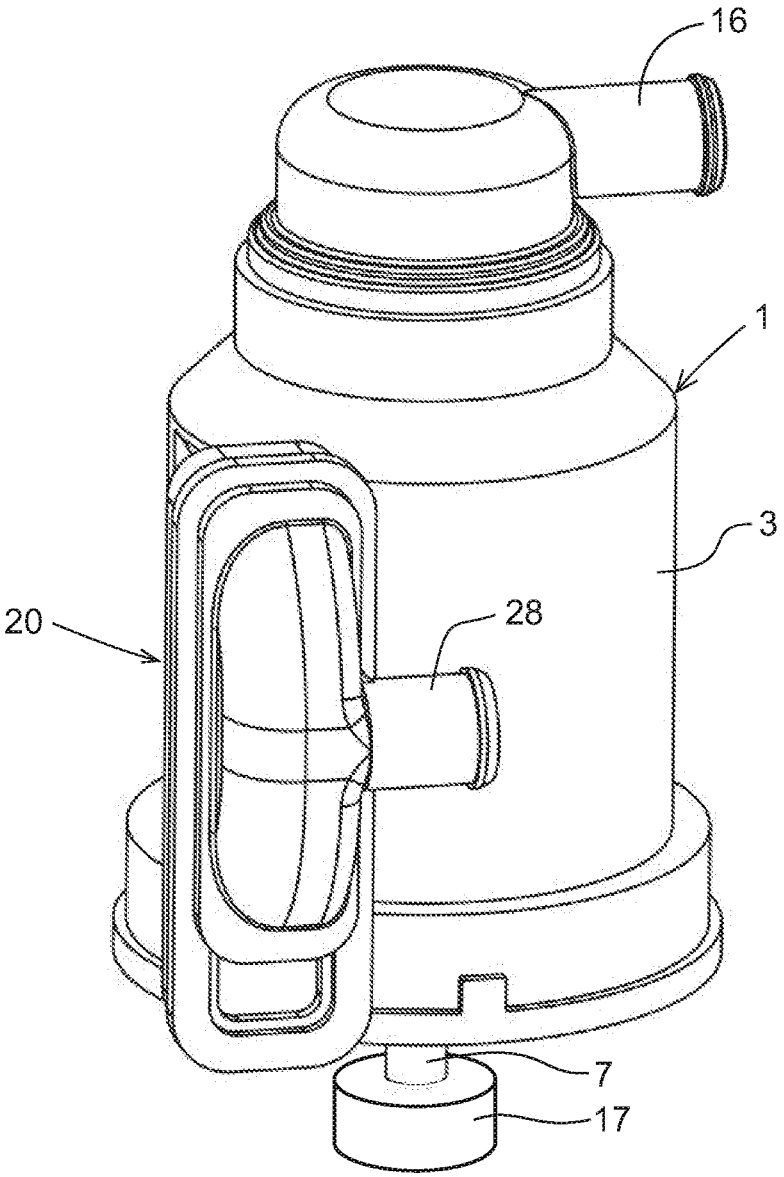
FIG. 1 discloses a perspective view of a centrifugal separator according to a first embodiment of the invention.

FIGS. 1 to 6 and 8 disclose a first embodiment of centrifugal separator for cleaning gases containing liquid impurities, especially crankcase gases of a combustion engine, which contain liquid impurities in the form of oil droplets and/or oil mist.

The centrifugal separator comprises a stationary casing 1, which is configured to be mounted to a combustion engine (not shown), especially a diesel engine, at a suitable position, such as on top of the combustion engine or at the side of the combustion engine.

It is to be noted that the centrifugal separator is also suitable for cleaning gases from other sources than combustion engines, for instance the environment of machine tools which frequently contains large amounts of liquid impurities in the form of oil droplets or oil mist.

The stationary casing 1 encloses a separation space 2 through which a gas flow is permitted. The stationary casing 1 comprises, or is formed by, a surrounding side wall 3, a first end wall 4 (in the embodiments disclosed an upper end wall) and a second end wall 5 (in the embodiments disclosed a lower end wall). The surrounding side wall 3 has a circular cross-section with a radius R from the axis x of rotation to the surrounding side wall 3, which is constant at least with respect to a major part of the circumference of the surrounding side wall 3. In particular, the side wall 3 is circular cylindrical.

Figure 4:
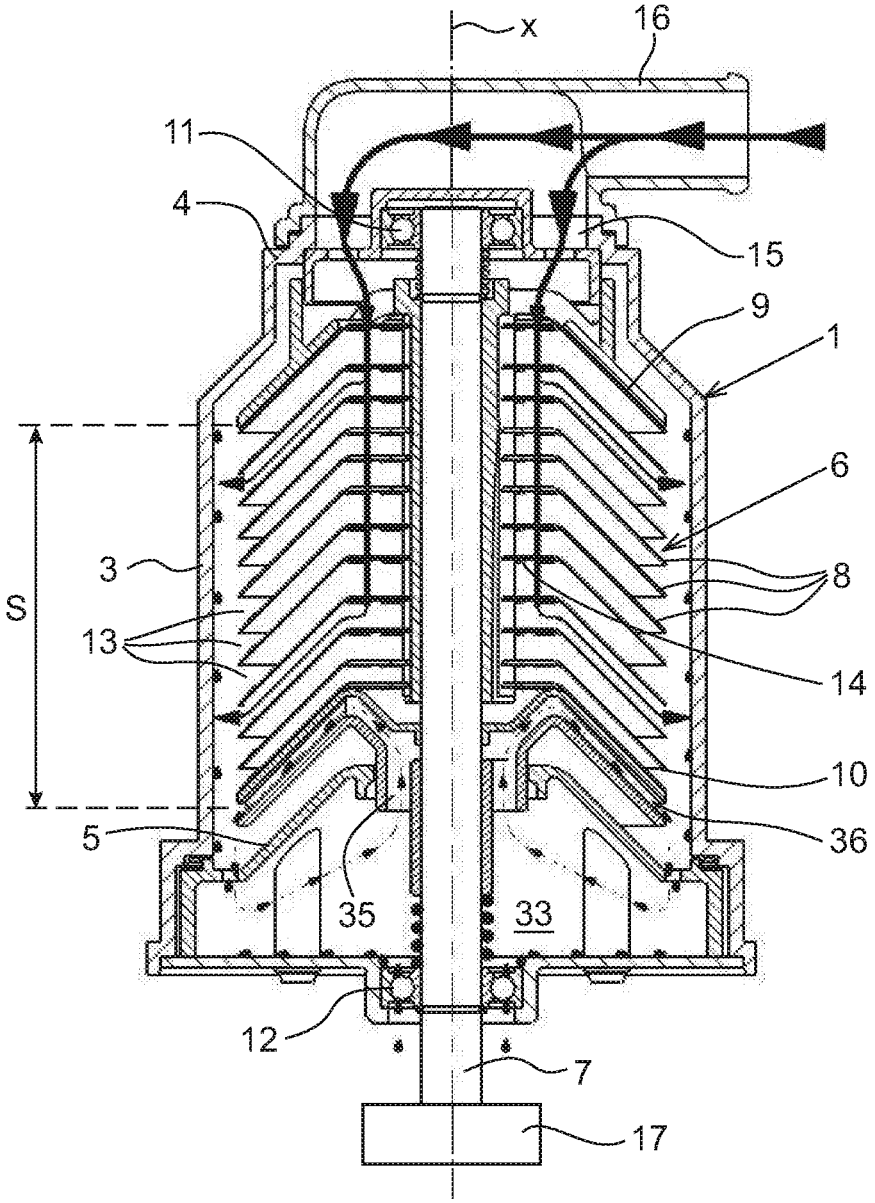
FIG. 4 discloses a sectional view along the line IV-IV in FIG. 2.
Figure 5:
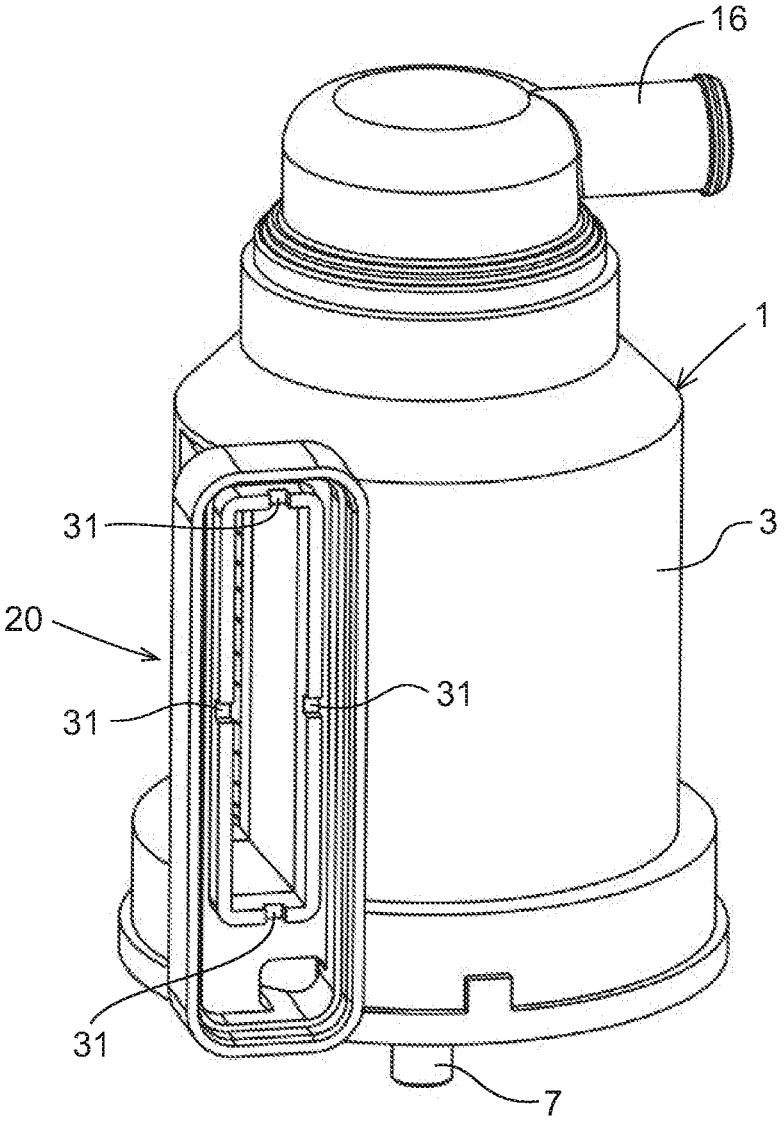
FIG. 5 discloses a perspective view similar to the one of FIG. 1 but in which an outlet conduit has been removed.
Figure 6:
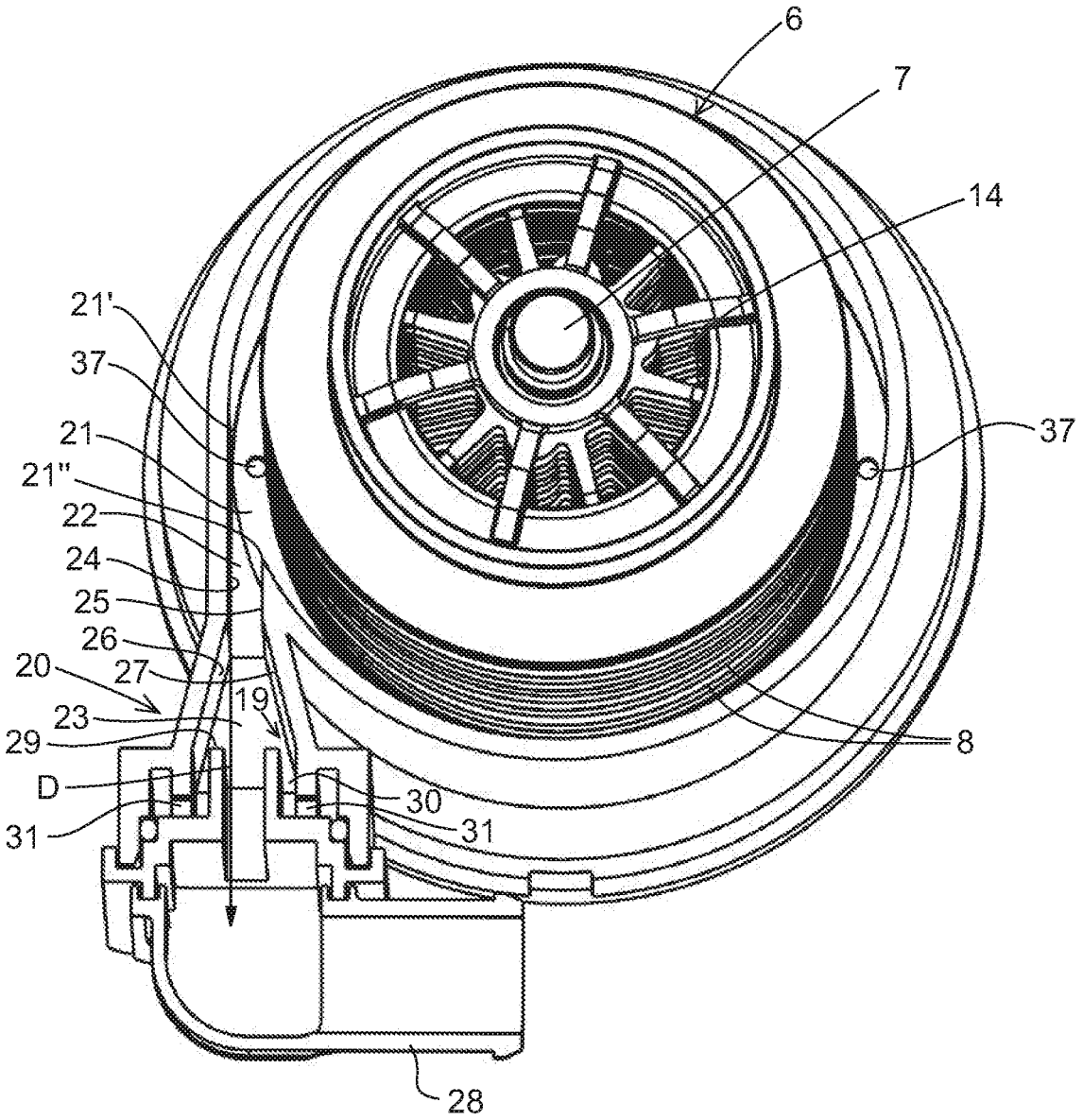
FIG. 6 discloses a perspective view from above of the centrifugal separator but in which a part of the stationary casing has been removed.

The centrifugal separator comprises a rotating member 6, see FIGS. 4 and 6, which is arranged to rotate around an axis x of rotation. It should be noted that the stationary casing 1 is stationary in relation to the rotating member 6, and preferably in relation to the combustion engine to which it may be mounted.

The rotating member 6 comprises a spindle 7 and a stack of separation disks 8 attached to the spindle 7. All the separation disks 8 of the stack of separation disks 8 are provided between a first end plate 9 (in the embodiments disclosed an upper end plate) and a second end plate 10 (in the embodiments disclosed a lower end plate), see FIG. 4.

The spindle 7, and thus the rotating member 6, is rotatably supported in the stationary casing 1 by means of a first bearing 11 (in the embodiments disclosed an upper bearing) and a second bearing 12 (in the embodiments disclosed a lower bearing), see FIG. 4.

The separation disks 8 are conical and extend downwardly and outwardly from the spindle 7. It should be noted that the separation disks 8 could also extend upwardly and outwardly, or even radially. The separation disks 8 are provided at a distance from each other by means of distance members (not shown) in order to form gaps 13 between adjacent separation disks 8, i.e. a gap 13 between each pair of adjacent separation disks 8. The axial thickness of each gap 13 may be in the order of 1-2 mm, for instance.

Each separation disk 8 may be made of plastics or metal. The number of separation disks 8 is normally higher than indicated in FIG. 4 and may be for instance 50 to 100 separation disks 8 depending on the size of the centrifugal separator.

The rotating member 6 defines a central space 14, see FIGS. 4 and 6. The central space 14 may be formed by a hole in each of the separation disks 8. In the embodiments disclosed the central space 14 is formed by a plurality of holes, see FIGS. 2 and 6, each extending through the first end plate 9 and through each of the separation disks 8.

The centrifugal separator comprises an inlet 15 for the supply of the gas to be cleaned. The inlet 15 extends through the stationary casing 1, and more precisely through the first end wall 4. The inlet 15 communicates with the central space 14 so that the gas to be cleaned is conveyed from the inlet 15 via the central space 14 to the gaps 13 of the stack of separation disks 8, see FIG. 4.

The inlet 15 is configured to communicate with the crankcase of the combustion engine, or any other source, via an inlet conduit 16 permitting the supply of crankcase gas from the crankcase to the inlet 15 and further to the central space 14 and the gaps 13 as explained above. The inlet conduit 16 disclosed may be comprised by the centrifugal separator.

The centrifugal separator comprises a schematically disclosed drive member 17 for rotating the rotating member 6. The drive member 17 is connected to the spindle 7. The drive member 17 may comprise a turbine wheel, see WO2012/152925, rotated by means of an oil jet from the oil system of the combustion engine, or a free jet wheel comprising a blow-back disk, see WO2014/023592, wherein the free jet is provided by the oil system of the combustion engine. Alternatively, the drive member 17 may be independent of the combustion engine and comprise an electric motor, a hydraulic motor or a pneumatic motor.

The centrifugal separator comprises a drainage outlet 19 configured to permit discharge of liquid impurities separated from the gas. The centrifugal separator also comprises a gas outlet 20 configured to permit discharge of cleaned gas. The liquid impurities of the gas will be separated from the gas in the gaps 13, and the cleaned gas will be conveyed out of the gaps 13 to the separation space 2 and further to the gas outlet 20.

The gas outlet 20 comprises an outlet opening 21 in the stationary casing 1, and in the embodiments disclosed in the side wall 3 of the stationary casing 1. The outlet opening 21 is elongated and configured as a slot through the side wall 3 of the stationary casing 1. The outlet opening 21 has an upstream point 21', or upstream axial line, and a downstream point 21", or downstream axial line, see FIGS. 2 and 8. In the first embodiment, the upstream point 21' and the downstream point 21" are located at the radius R from the axis x of rotation.

Figure 3:
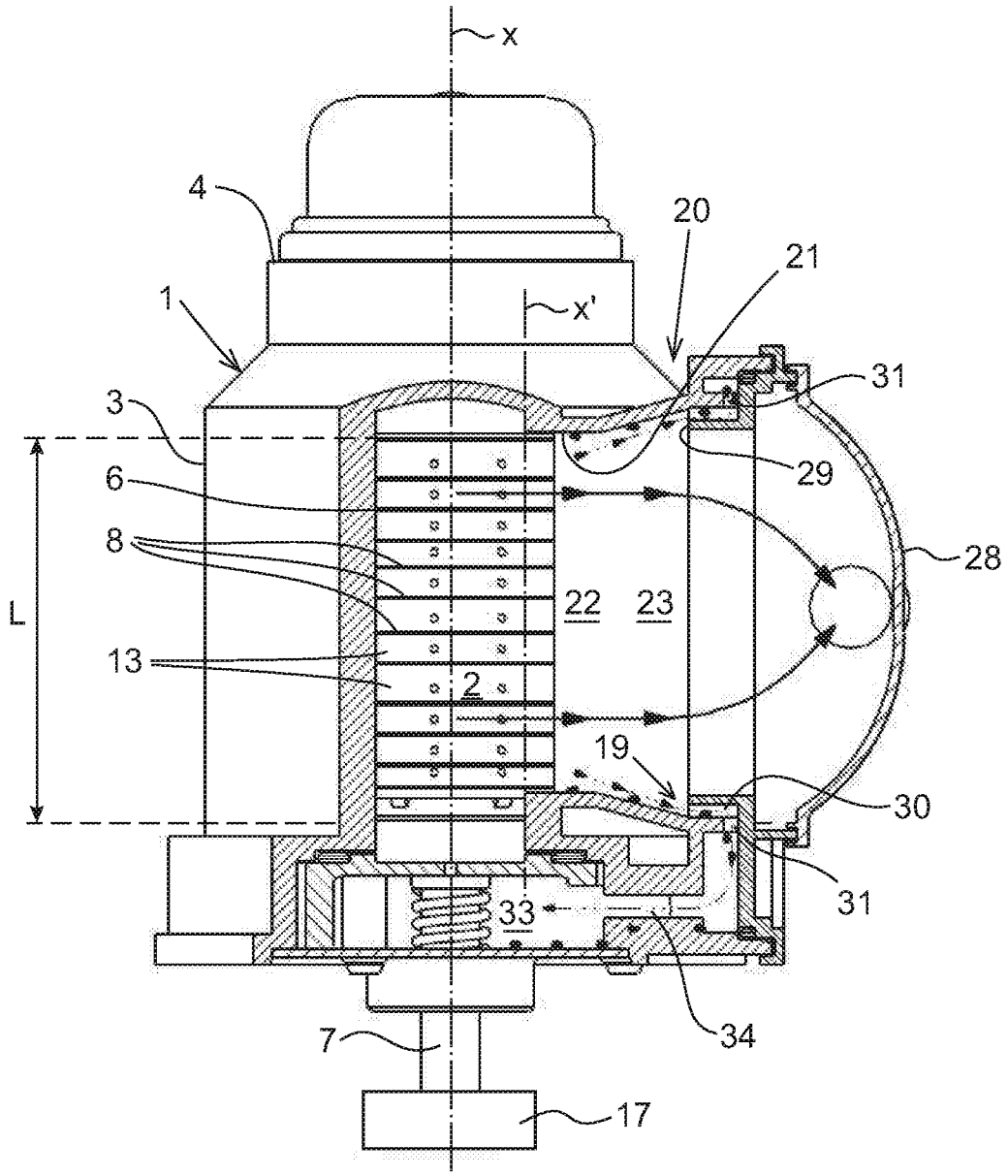
FIG. 3 discloses a sectional view along the line III-III in FIG. 2.

Thus, the outlet opening 21 has an elongated shape along a longitudinal axis x'. In the embodiments disclosed, the longitudinal axis x' is parallel or substantially parallel with the axis x of rotation as can be seen in FIG. 3. However, it is to be noted that the longitudinal axis x', i.e. the extension of the inlet opening 21, may slope slightly to the axis x of rotation. In other words, the longitudinal axis x' may have a major component of direction which is parallel with the axis x of rotation, and in that case a minor component of direction, which is perpendicular to the axis x of rotation (not shown).

The outlet opening, or slot, 21, is positioned opposite, or just opposite, to the stack of separation disks 8. Thus, the outlet opening 21 is thus positioned laterally beside the stack of separation disks 8, which means that the distance from the gaps 13 to the outlet opening 21 is short, and may be the same for each gap 13 to the outlet opening 21.

The stack of separation disks 8 has an outer circumferential periphery and an axial length S at the outer circumferential periphery, see FIG. 4. The outlet opening 21 has a length L along the longitudinal axis x', see FIG. 3. The length L is 80-130% of the axial length S, preferably 90-120% of the axial length S, and more preferably 100-110% of the axial length S. In particular, the length L may be at least equal to, or correspond to the axial length S, or be in the same order as the axial length S. If the length L is at least equal to the axial length S, an equal distance from each gap 13 to the outlet opening 21 may be ensured.

Figure 2:
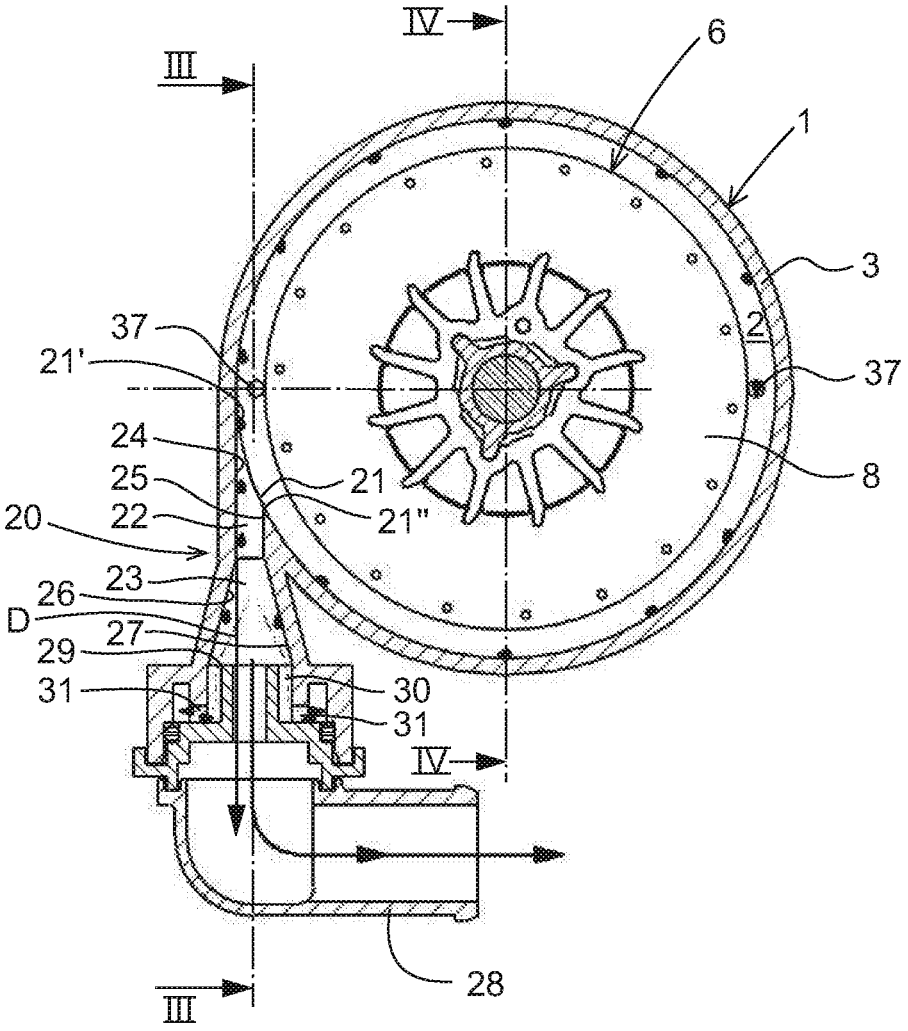
FIG. 2 discloses a cross-sectional view perpendicular to an axis of rotation of the centrifugal separator in FIG. 1.

The gas outlet 20 has an upstream portion 22 and a downstream portion 23, see FIGS. 2, 3 and 6. The upstream portion 22 extends from, or starts at, the outlet opening 21. At least the upstream portion 22 extends in an outlet direction D as can be seen in FIG. 2.

The outlet direction D extends through an upstream point 21' of the outlet opening 21 and is parallel with a transversal line T extending through the axis x of rotation. The perpendicular distance P between the outlet direction D and the transversal line T is at least 0.8R and at the most 1.2R.

In the embodiments disclosed in FIGS. 1-8, the perpendicular distance between the outlet direction D and the transversal line T is equal to, or substantially equal to, the radius R. Thus the outlet direction D is a tangential direction with respect to the axis x of rotation. The downstream point 21" is located at a shorter perpendicular distance P to the transversal line T than the outlet direction D.

The upstream portion 22 has a constant cross-section when seen in a section transversal to the axis x of rotation, as can be seen in FIGS. 2 and 6. This means that the upstream portion 22 has upstream outlet walls 24, 25 that are parallel with each other, and with the outlet direction D. In particular, the upstream outlet wall 24 coincides with the outlet direction D.

In the embodiments disclosed the upstream outlet walls 24, 25 are also parallel with the axis x of rotation.

The distance between the two upstream outlet walls 24 and 25 is shorter, or significantly shorter, than the length L, and the radius R.

The downstream portion 23 and has an increasing cross-section when seen in the section transversal to the axis x of rotation shown in FIG. 2. This means that the downstream portion 22 has downstream outlet walls 26, 27 that are diverging from each other.

The drainage outlet 19 is provided in the gas outlet 20 at the downstream end of the downstream portion 23 of the gas outlet 20 as illustrated in FIGS. 2 and 6. The gas outlet 20 is thus configured to convey the liquid impurities, which have been separated from the gas, to the drainage outlet 19.

The liquid impurities, which are illustrated as exaggerated spots in the figures and are transported from the gaps 13 to an inner side of the side wall 3 due to the centrifugal force, where they form a film of separated oil. The rotary movement conveys the film of separated oil along the inner side of the side wall 3 to the outlet opening 21 and the gas outlet 20. The film of separated oil is then conveyed outwardly on the inside walls of the gas outlet 20, comprising the upstream outlet walls 24, 25 and the downstream outlet walls 26, 27, to the drainage outlet 19.

The gas outlet 20 comprises an outlet conduit 28 having an entry portion 29. The drainage outlet 19 comprises a ditch 30 extending around the entry portion 29 of the outlet conduit 28.

The entry portion 29 and the ditch 30 are provided downstream the upstream portion 22, and at the downstream end of the downstream portion 23.

The cleaned gas may thus be discharged via the gas outlet 20 to the outlet conduit 28. The outlet conduit 28 may advantageously recirculate the cleaned gas, for instance to the inlet side of the combustion engine.

The drainage outlet 19 comprises in the embodiments disclosed four drainage openings 31 extending from the ditch 30. Of course the drainage outlet 19 may comprise another number of such drainage openings 31, for instance one, two, three, five or even more drainage openings 31.

The gas outlet 20 will thus convey the cleaned gas along a central flow in the gas outlet 20 and the liquid impurities, as a film of separated oil, along the inside walls of the gas outlet 20 to the drainage outlet 19. The central flow of the cleaned gas will be conveyed through the entry portion 29 of the outlet conduit 28, and the liquid impurities will be collected in the ditch 30 around the entry portion 29.

The centrifugal separator also comprises an end space 33, which is provided outside the separation space 2. In the embodiments disclosed the end space 33 is located outside second end wall 5 as can be seen in FIG. 4. The end space 33 communicates with the drainage outlet 19 via a drainage channel 34, see FIG. 3, that extends from the drainage openings 31. The separated liquid impurities collected in the ditch 30 will thus conveyed, together with a peripheral flow of cleaned gas, to the end space 33 via the drainage openings 31 and the drainage channel 34. From the end space 33, the liquid impurities may be conveyed through the bearings 11, 12, especially the second bearing 12 as illustrated in FIG. 4. The peripheral flow of cleaned gas is smaller, or significantly smaller, than the central flow of cleaned gas.

A central suction opening 35 extends between the separation space 2 and the end space 33 through the second end wall 5, see FIG. 4. The central suction opening 35 has an annular cross-sectional shape and is provided around the spindle 7. The central suction opening 35 permits a re-circulating gas flow from the end space 33 to the separation space 2. The peripheral flow of cleaned gas may thus be recirculated to the separation space 2.

According to the first embodiment, the centrifugal separator comprises a fan member 36 provided between the second end wall 5 and the stack of separation disks 8. The fan member 36 is provided outside the central suction opening 35 and promotes further the re-circulating gas flow from the end space 33 to the separation space 2.

In the embodiments disclosed, the second end wall 5 has two apertures 37 located adjacent to the side wall 3. The apertures 37 provides communication channels between the separation space 2 and the end space 33 for separated liquid impurities collected on the second end wall 5. The liquid impurities may thus pass through the apertures 37 into the end space 33 as illustrated in FIG. 4, together with a minor amount of cleaned gas.

Figure 7:
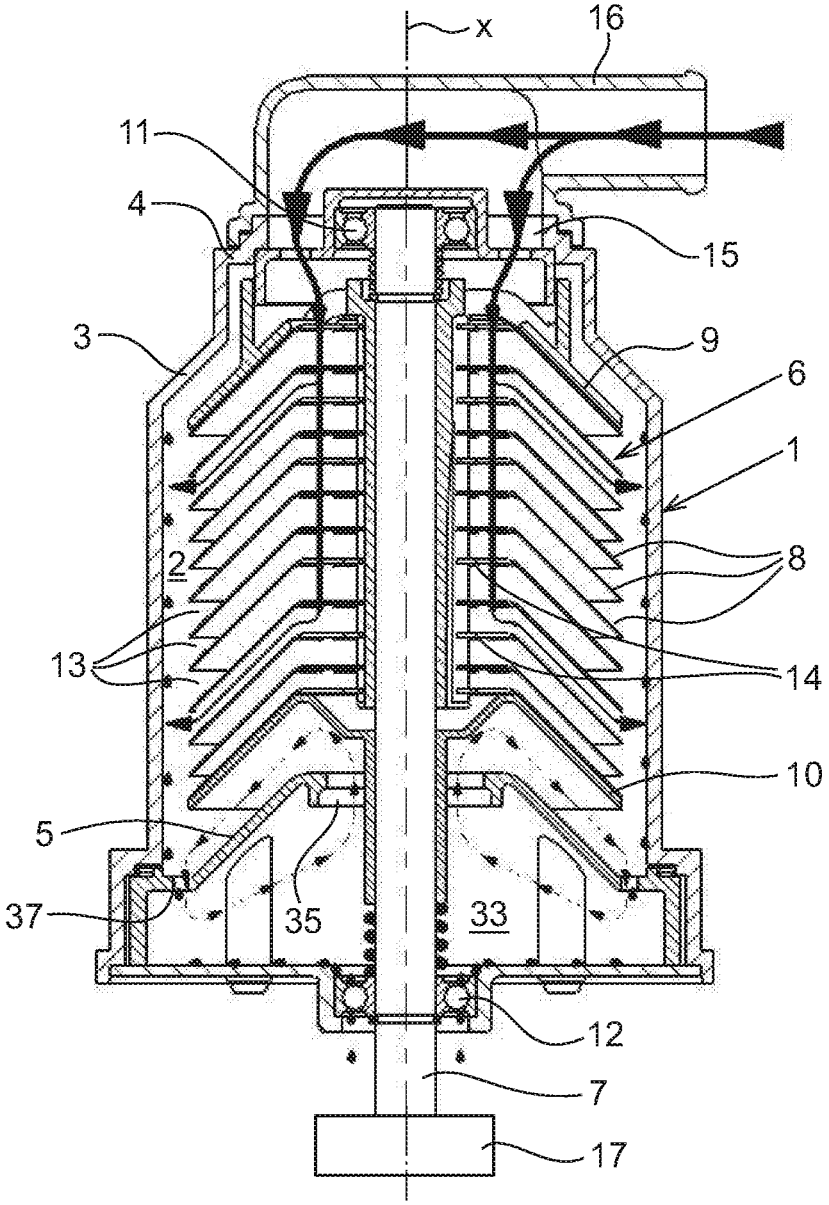
FIG. 7 discloses a sectional view of a centrifugal separator according to a second embodiment, which view is similar to the one in FIG. 4.
Figure 8:
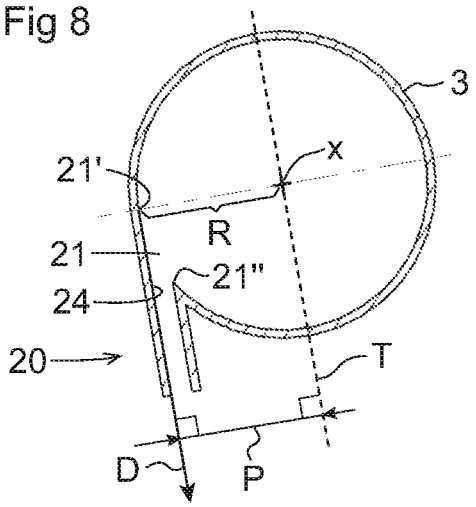
FIG. 8 illustrates the direction of a gas outlet of the centrifugal separator in FIG. 1.

FIG. 7 discloses a second embodiment, which differs from the first embodiment in that no fan member is provided. The central suction opening 35 extends through the second end wall 5 between the separation space 2 and the end space 33. Also in this case, the central suction opening 35 permits a re-circulating gas flow from the end space 33 to the separation space 2, since the pressure in the central part of the separation space 2 will be lower than in the radially outer part of the separation space and in the end space 33 due to the pumping effect of the stack of separation disks 8.

Figure 9:
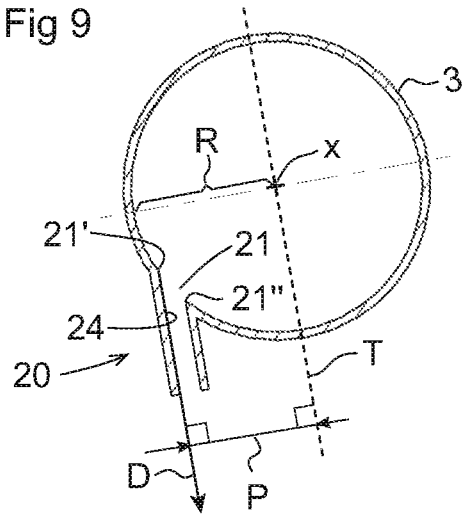
FIG. 9 illustrates the direction of the gas outlet of a centrifugal separator according to a third embodiment of the invention.
Figure 10:
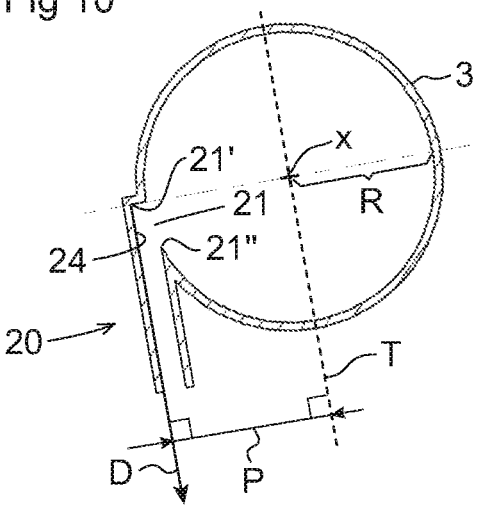
FIG. 10 illustrates the direction of the gas outlet of a centrifugal separator according to a fourth embodiment of the invention.
Figure 11:
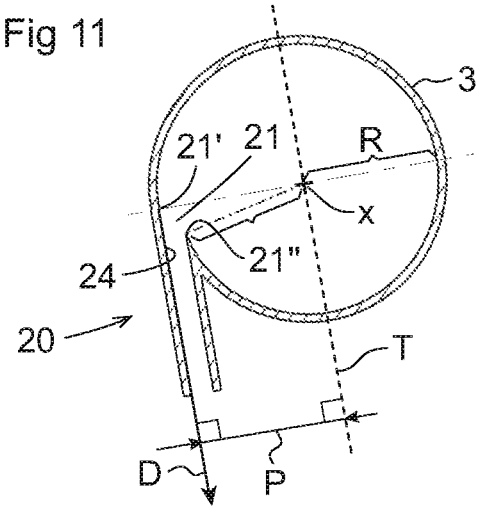
FIG. 11 illustrates the direction of the gas outlet of the centrifugal separator according to a fifth embodiment of the invention.

It is to be noted that the outlet direction D may have another extension than shown in FIGS. 1-8. FIGS. 9-11 disclose further embodiments, which differs from the first embodiment only with respect to the outlet direction D of the gas outlet 20.

FIG. 9 illustrates a third embodiment, in which the upstream point 21' forms a convex, or sharp convex, corner between the inner side of the side wall 3 and the upstream wall 24 forming an outer upstream wall. It should be noted that the corner may be rounded. The upstream outlet wall 24, which is parallel, or coincides, with the outlet direction D, is parallel with the transversal line T.

In the third embodiment, the perpendicular distance P between the outlet direction D and said transversal line T is shorter than the radius R and approximately 0.9R. The perpendicular distance between the transversal line T and the downstream point 21" is shorter than 0.9R.

FIG. 10 illustrates a fourth embodiment, in which the upstream point 21' is located at the end of a transition region between the inner side of the side wall 3 and the upstream outlet wall 24. The upstream outlet wall 24, which is parallel with the outlet direction D, is parallel, or coincides, with the transversal line T but located outside a tangential plane. The transition region may coincide with a radial line as shown in FIG. 7, configured as a line inclined with respect to a radial line, or as a smooth transition from the inner side of the side wall 3 to the upstream outlet wall 24 and the upstream point 21'.

In the fourth embodiment, the perpendicular distance P between the outlet direction D and the transversal line T is longer than the radius R and approximately 1.1R. The perpendicular distance between the transversal line T and the downstream point 21" may be longer than equal to or as shown in FIG. 11 shorter than the radius R.

FIG. 11 illustrates a fifth embodiment, in which the upstream outlet wall 24 is parallel, or coincides, with the outlet direction D and the transversal line T. In the fifth embodiment the side wall 3 deviates from a cylindrical shape along a segment upstream the outlet opening 21.

In the fifth embodiment, the perpendicular distance P between the outlet direction D and the transversal line T is longer than the radius R and approximately 1.1R. The perpendicular distance between the transversal line T and downstream point 21" may be longer than, equal to or as shown in FIG. 11 shorter than the radius R, which is approximately 0.9R.

The present invention is not limited to the embodiments disclosed, but mat be varied and modified within the scope of the following claims.

What is claimed is:

1. A centrifugal separator for cleaning a gas containing liquid impurities, the centrifugal separator comprising:

a stationary casing, enclosing a separation space through which a gas flow is permitted, the stationary casing comprising a surrounding side wall, a first end wall and a second end wall;

an inlet extending through the stationary casing and permitting supply of the gas to be cleaned;

a rotating member comprising a stack of separation disks and being arranged to rotate around an axis of rotation;

a drive member, for rotating the rotating member;

a gas outlet configured to permit discharge of cleaned gas, wherein the gas outlet comprises an outlet opening through the stationary casing and an upstream portion extending from the outlet opening; and a drainage outlet configured to permit discharge of liquid impurities separated from the gas, the drainage outlet being provided in the gas outlet downstream of the upstream portion, wherein the gas outlet is configured to convey the liquid impurities to the drainage outlet.

2. The centrifugal separator according to claim 1, wherein the gas outlet comprises an outlet conduit having an entry portion provided downstream the upstream portion, and wherein the drainage outlet comprises a ditch extending around the entry portion of the outlet conduit.

3. The centrifugal separator according to claim 2, wherein the drainage outlet comprises at least one drainage opening extending from the ditch.

4. The centrifugal separator according to claim 1, wherein the gas outlet has a downstream portion provided downstream of the upstream portion and having an increasing cross-section extending away from the upstream portion.

5. The centrifugal separator according to claim 2, wherein the drainage outlet and the entry portion of the outlet conduit are provided at the end of the downstream portion.

6. The centrifugal separator according to claim 4, wherein the downstream portion extends from the upstream portion.

7. The centrifugal separator according to claim 1, wherein the outlet opening of the gas outlet extends through the side wall of the stationary casing.

8. The centrifugal separator according to claim 1, wherein an end space is provided outside the separation space and communicates with the drainage outlet via a drainage channel that extends from the drainage opening.

9. The centrifugal separator according to claim 8, wherein a central suction opening extends between the separation space and the end space through the second end wall to permit a re-circulating gas flow from the end space to the separation space.

10. The centrifugal separator according to claim 9, wherein a fan member is provided between the second end wall and the stack of separation disks to further promote said re-circulating gas flow.

11. The centrifugal separator according to claim 9, wherein the second end wall adjacent to the side wall has a number of apertures providing communication channels between the separation space and the end space for separated liquid impurities.

12. The centrifugal separator according to claim 1, wherein the upstream portion has upstream outlet walls that are substantially parallel with each other.

13. The centrifugal separator according to claim 1, wherein the stationary casing has a radius R from the axis of rotation to the surrounding side wall, and wherein the upstream portion has an inner sidewall and an outer sidewall which extend from the outlet opening in an outlet direction parallel with a transversal line extending through the axis of rotation, the perpendicular distance between the outer sidewall and said transversal line is at least 0.8R and at the most 1.2R.

14. The centrifugal separator according to claim 1, wherein the outlet opening has an elongated shape along a longitudinal direction.

15. The centrifugal separator according to claim 14, wherein the stack of separation disks has an outer circumferential periphery and an axial length at the outer circumferential periphery, and wherein the outlet opening along the longitudinal direction has a length which is 80-130% of the axial length.

16. A centrifugal separator according to claim 1, wherein the separation disks are provided at a distance from each other to form a gap between adjacent separation disks and wherein the rotating member defines a central space formed by at least one hole in each of the separation disks and connected to the inlet and configured to convey the gas to be cleaned from the inlet to the gaps of the stack of separation disks.

17. A centrifugal separator for cleaning a gas containing liquid impurities, the centrifugal separator comprising:

a stationary casing, enclosing a separation space through which a gas flow is permitted, the stationary casing comprising a surrounding side wall, a first end wall and a second end wall;

an inlet extending through the stationary casing and permitting supply of the gas to be cleaned;

a rotating member comprising a stack of separation disks and being arranged to rotate around an axis of rotation;

a drive member, for rotating the rotating member;

a gas outlet configured to permit discharge of cleaned gas, wherein the gas outlet comprises an outlet opening through the stationary casing and a portion extending from the outlet opening; and a drainage outlet configured to permit discharge of liquid impurities separated from the gas, the drainage outlet being a ditch that surrounds the gas outlet.

18. The centrifugal separator according to claim 17, wherein the ditch comprises an inner wall and an outer wall and at least one drainage opening formed in the inner wall of the ditch.

19. The centrifugal separator according to claim 18, further comprising a liquid outlet between the inner wall and outer wall of the ditch.

20. The centrifugal separator according to claim 17, further comprising an outlet conduit connected to the gas outlet, wherein the drainage outlet has an inner wall and an outer wall, and wherein an end of the outlet conduit extends inside the inner wall of the drainage outlet.

* * * * *